US005287830A

United States Patent [19]

Dopson et al.

[11] Patent Number: 5,287,830

[45] Date of Patent: Feb. 22, 1994

[54] VALVE CONTROL MEANS

[75] Inventors: Clive Dopson, Norwich; Jeffrey Allen, Attleborough, both of England

[73] Assignee: Group Lotus, United Kingdom

[21] Appl. No.: 920,389

[22] PCT Filed: Feb. 15, 1991

[86] PCT No.: PCT/GB91/00233

§ 371 Date: Aug. 14, 1992

§ 102(e) Date: Aug. 14, 1992

[87] PCT Pub. No.: WO91/12413

PCT Pub. Date: Aug. 22, 1991

[30] Foreign Application Priority Data

Feb. 16, 1990 [GB] United Kingdom ..... 9003603
Mar. 29, 1990 [GB] United Kingdom ..... 9007022

[51] Int. Cl.[5] ..... F01L 1/34; F01L 1/14
[52] U.S. Cl. ..... 123/90.16; 123/90.48
[58] Field of Search ..... 123/90.15, 90.16, 90.22, 123/90.27, 90.48, 90.52, 90.55

[56] References Cited

U.S. PATENT DOCUMENTS

| | | | |
|---|---|---|---|
| 4,151,817 | 5/1979 | Mueller | 123/90.16 |
| 4,222,354 | 9/1980 | Uitvlugt | 123/90.16 |
| 4,230,076 | 10/1980 | Mueller | 123/90.16 |
| 4,411,229 | 10/1983 | Curtis et al. | 123/90.16 |
| 4,475,489 | 10/1984 | Honda | 123/90.16 |
| 4,537,165 | 8/1985 | Honda et al. | 123/90.16 |
| 4,559,909 | 12/1985 | Honda et al. | 123/90.28 |
| 4,576,128 | 3/1986 | Kenichi | 123/90.16 |
| 4,690,110 | 9/1987 | Nishimura et al. | 123/90.17 |
| 4,718,379 | 1/1988 | Clark | 123/90.39 |
| 4,726,332 | 2/1988 | Nishimura et al. | 123/90.16 |
| 4,727,831 | 3/1988 | Nagahiro et al. | 123/90.16 |
| 4,741,297 | 5/1988 | Nagahiro et al. | 123/90.16 |
| 4,762,096 | 8/1988 | Kamm et al. | 123/90.16 |
| 4,768,467 | 9/1988 | Yamada et al. | 123/90.16 |
| 4,779,589 | 10/1988 | Matsuura et al. | 123/90.15 |
| 5,046,462 | 9/1991 | Matayoshi et al. | 123/90.16 |
| 5,090,364 | 2/1992 | McCarroll et al. | 123/90.16 |
| 5,193,496 | 3/1993 | Krüger | 123/90.16 |

FOREIGN PATENT DOCUMENTS

| | | |
|---|---|---|
| 0213758 | 3/1987 | European Pat. Off. . |
| 0213759 | 3/1987 | European Pat. Off. . |
| 0258061 | 3/1988 | European Pat. Off. . |
| 0259106 | 3/1988 | European Pat. Off. . |
| 0262269 | 4/1988 | European Pat. Off. . |
| 0264253 | 4/1988 | European Pat. Off. . |

(List continued on next page.)

*Primary Examiner*—E. Rollins Cross
*Assistant Examiner*—Weilun Lo
*Attorney, Agent, or Firm*—Fulwider Patton Lee & Utecht

[57] ABSTRACT

The valve control means for an internal combustion engine comprises valve means (10), cam means comprising a camshaft (30) having a first cam member (23) and a second cam member (26) having a different profile from the first cam member (23) and means (18) for transmitting reciprocating movement to the valve means (10) from the cam means (23 or 26). The means (18) for transmitting reciprocating movement comprises a first cam follower member (20) in engagement with the valve means (10) and a second cam follower member (21) movable relative to the first cam follower member (20), and locking means (27) to enable the follower members (20 and 21) to be linked to move together. When the follower members (20 and 21) are not linked the valve means (10) is controlled by the first cam follower member (20) in engagement with and following the profile of the first cam member (23) and when the follower members (20 and 23) are linked the valve means (10) is controlled by the second cam follower member (21) in engagement with and following the profile of the second cam member (26).

26 Claims, 5 Drawing Sheets

U.S. PATENT DOCUMENTS

| | | |
|---|---|---|
| 0265191 | 4/1988 | European Pat. Off. . |
| 0265281 | 4/1988 | European Pat. Off. . |
| 0265282 | 4/1988 | European Pat. Off. . |
| 0267696 | 5/1988 | European Pat. Off. . |
| 0275713 | 7/1988 | European Pat. Off. . |
| 0275714 | 7/1988 | European Pat. Off. . |
| 0275715 | 7/1988 | European Pat. Off. . |
| 0276531 | 8/1988 | European Pat. Off. . |
| 0276532 | 8/1988 | European Pat. Off. . |
| 0276533 | 8/1988 | European Pat. Off. . |
| 0276577 | 8/1988 | European Pat. Off. . |
| 0291357 | 11/1988 | European Pat. Off. . |
| 0293209 | 11/1988 | European Pat. Off. . |
| 0297791 | 1/1989 | European Pat. Off. . |
| 0300679 | 1/1989 | European Pat. Off. . |
| 0312216 | 4/1989 | European Pat. Off. . |
| 0317371 | 5/1989 | European Pat. Off. . |
| 0317372 | 5/1989 | European Pat. Off. . |
| 0318303 | 5/1989 | European Pat. Off. . |
| 0323233 | 7/1989 | European Pat. Off. . |
| 0338729 | 10/1989 | European Pat. Off. . |
| 0342007 | 11/1989 | European Pat. Off. . |
| 0342051 | 11/1989 | European Pat. Off. . |
| 0343931 | 11/1989 | European Pat. Off. . |
| 0347211 | 12/1989 | European Pat. Off. . |
| 0353862 | 2/1990 | European Pat. Off. . |
| 0353863 | 2/1990 | European Pat. Off. . |
| 0353988 | 2/1990 | European Pat. Off. . |
| 0359363 | 3/1990 | European Pat. Off. . |
| 0364081 | 4/1990 | European Pat. Off. . |
| 0405927A1 | 1/1991 | European Pat. Off. . |
| 2753197 | 6/1978 | Fed. Rep. of Germany . |
| 2952037 | 6/1981 | Fed. Rep. of Germany . |
| 3347680 | 8/1984 | Fed. Rep. of Germany . |
| 1476357 | 6/1977 | United Kingdom . |
| 1551360 | 8/1979 | United Kingdom . |
| 1569598 | 6/1980 | United Kingdom . |
| 1604707 | 12/1981 | United Kingdom . |
| 2196694B | 5/1988 | United Kingdom . |

VALVE CONTROL MEANS

The invention relates to a valve control means for controlling the inlet and exhaust valves of an internal combustion engine.

Internal combustion engines for use in, for example, vehicles, must be capable of operation at various engine speeds and loads. The timing of the opening and closing of the intake and exhaust valves must be set to optimise the power output and efficiency of the engine over a reasonable range of speeds and loads.

For example, in a high output, multi-valve, spark ignition four stroke engine which is designed to operate at high engine speeds, it is generally desirable to provide means, such as cams, to control the opening of the inlet valves which preferably have a long valve opening period, in order to maximise the combustible charge drawn into the combustion chambers during the suction strokes of the engine. This has the advantage of improving the volumetric efficiency of the engine, thereby increasing the maximum power and torque outputs of the engine.

However, if such an engine is operated at speeds below that at which maximum power is developed, since the inlet valves are open for a relatively long period, some of the combustible charge drawn into each combustion chamber on its suction stroke can be forced back through the valve before it closes. This effect clearly reduces the volumetric efficiency, and hence the output, of the engine. It also causes uneven engine idling and low speed operation, and also makes exhaust emissions more difficult to control.

It is therefore desirable to additionally provide a valve control mechanism for use only at low engine speeds which has a relatively short operating or opening period.

There have already been a number of proposals for variable valve timing devices in which means are provided for changing the duration of the opening of the valve in an internal combustion engine.

For example in U.S. Pat. No. 4,727,831 a pair of adjacent valves are controlled to operate together by means of rocker shafts and cams. The two valves are normally driven from the camshaft by two low-speed cams (i.e. cams causing the valves to open for a short duration) operating on separate rocker arms for each valve but a third rocker arm is mounted between the two aforesaid rocker arms and is arranged to be driven by a high-speed cam (i.e. a cam causing the valve to open for a long duration). When it is desired to operate the valves via the high-speed cam the third rocker arm is connected to the other two rocker arms so that the valves are both driven via the third rocker arm.

In U.S. Pat. No. 4,475,489 a valve is driven either by a first rocker arm driven by a high-speed cam or a second rocker arm driven by a low-speed cam and means is provided to move the two rocker arms between operative and inoperative positions whereby the valve is driven by either of the rocker arms. There is an overlap between the high-speed and low-speed positions where both rocker arms are driving the valve in order to overcome the problem that if there is no overlap both of the rocker arms will be at intermediate positions at which an undesirable impact takes place between the valve and the rocker arms.

In applicant's co-pending application No. 9003603.9 a value is controlled by a pair of rocker arms which are movable into direct or indirect engagement by high speed or low speed cam means. A locking hydraulic piston arrangement is operable to move a cam follower mounted on one of said rocker arms into engagement with a high speed cam to provide high speed control of the valve. When this arm is retracted the cam follower mounted on the other arm is in sole engagement with a different profile of the cam to provide low-speed control.

GB-A-2017207 illustrates a variable type valve timing mechanism having a tapered finger which in different positions causes different profiles of cam means to engage and control directly or indirectly the tappet mounted on the valve.

According to the present invention there is provided valve control means for an internal combustion engine comprising valve means, cam means comprising a rotatable camshaft having a first cam member and a second cam member having a different profile from said first cam member, means for transmitting reciprocating movement to the valve from said cam means, said means comprising a first cam follower member in engagement with said valve and a second cam follower member movable relative to said first cam follower member, and locking means to enable said follower members to be linked so as to move together, wherein when the follower members are not so linked the valve means is controlled by the first cam follower member in engagement with and following the profile of the first cam member and when the follower members are linked the valve means is controlled by the second cam follower member in engagement with and following the profile of the second cam member.

Thus it is possible to switch between one cam and another to accomodate different speeds and loads of the engine.

Preferably actuating means are provided to actuate and de-actuate the locking means for different speeds and loads of the engine, which actuating means are manually or automatically operable.

Preferably the follower means are linked at higher engine speeds to improve efficiency of the engine.

Preferably the locking means comprises a locking element movable within said second cam follower member and held restrained in an unlocked position by spring means. The locking means preferably comprises a locking element movable within said second cam follower member and held restrained in an unlocked position by fluid pressure and the locking element preferably has a shaped surface adapted to co-operate with a complementary surface of said first cam follower member in a locked position.

Preferably the locking element is moved from an unlocked position to a locked position by means of fluid pressure.

Preferably the second cam follower member is held in engagement with the second cam member by spring means and the first cam follower member is preferably biased toward said first cam member by spring means, which spring means preferably holds the first cam follower member in engagement with the first cam member when the cam follower members are not linked to move together.

In a preferred embodiment the valve control means comprises additionally a third cam follower member located between said first cam follower member and said first cam member to provide indirect engagement therebetween. The third follower member is preferably held in engagement with said first cam member by spring means.

Preferably the valve control means further comprises a hydraulic lash adjustment element located between the valve and said first cam follower member.

In a preferred method of operation of the valve control means when the second cam follower member is linked in engagement with said first cam follower member there is a gap between said first cam follower member and said first cam member.

The invention further provides an internal combustion engine having valve control means as hereinbefore described.

There will now be described a specific embodiment of the invention, by way of example only, with reference to and as shown in the accompanying drawings in which.

Figure 1:
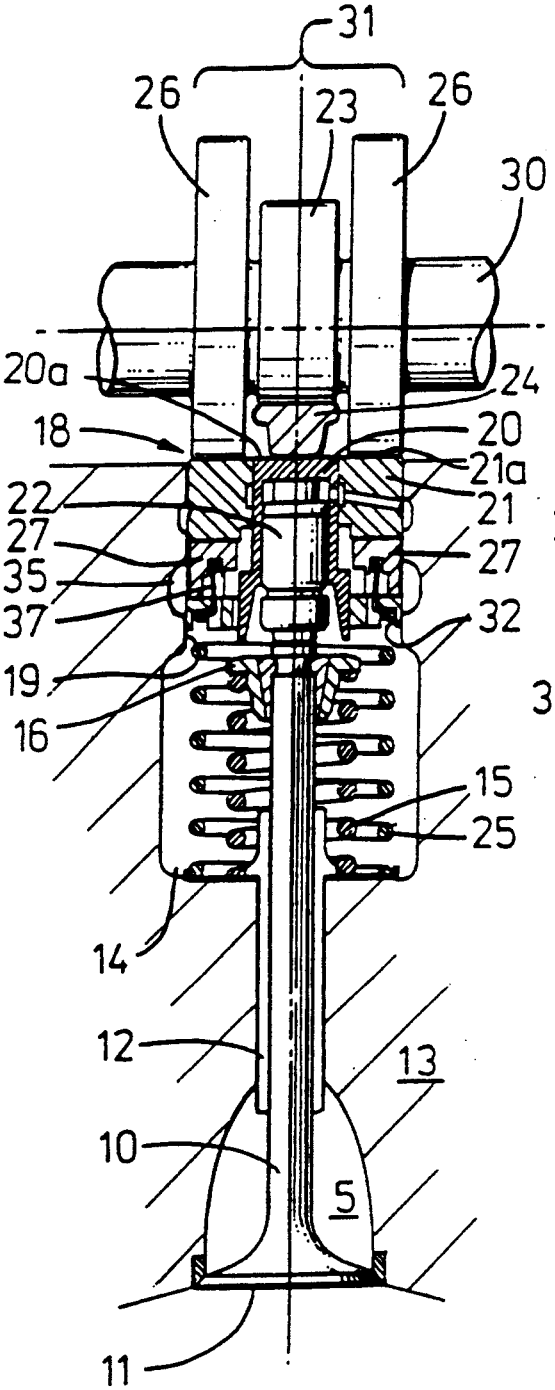
FIG. 1 is a side sectional view of a tappet and valve assembly for an internal combustion engine.
Figure 2:
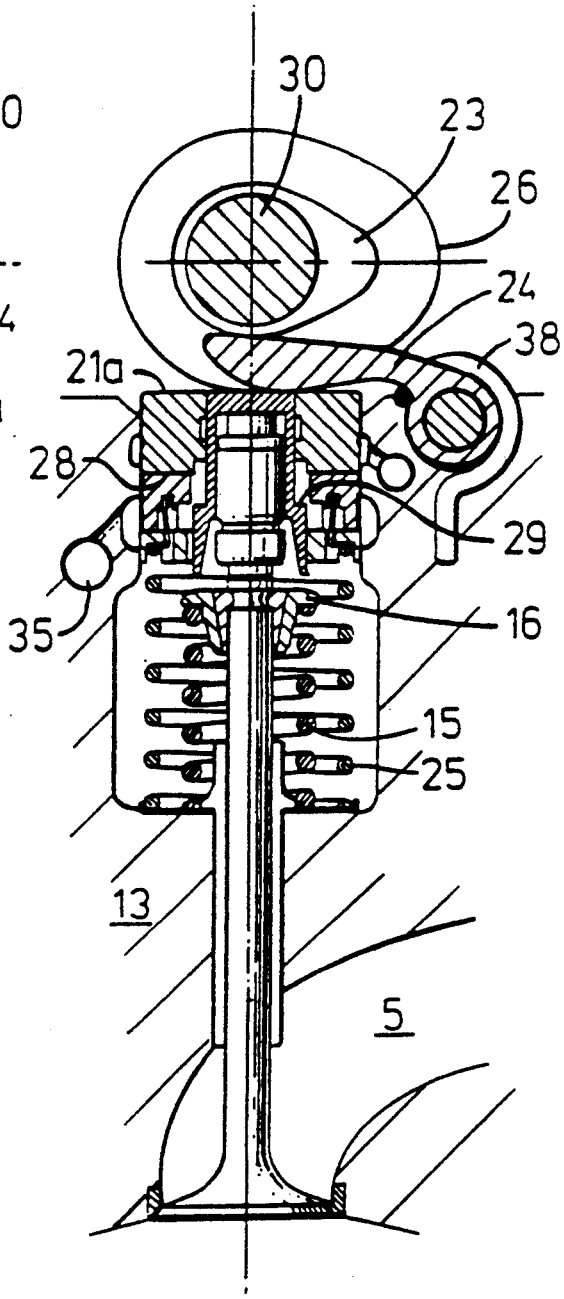
FIG. 2 is a vertical sectional view of the valve and tappet assembly of FIG. 1.

An internal combustion engine (not shown) has a plurality of pistons slidably mounted within a plurality of cylinders in a cylinder block (13) a portion of which is shown in FIG. 1. Each cylinder has an intake and an exhaust passage (5) and an intake and exhaust valve (10) movable to open or close the passages.

It is apparent that the invention may be applied both to inlet and exhaust valves and although only a single valve is referred to and described in the following description it should be recognised that it may also refer to inlet and/or exhaust valves, a plurality of one type of valve or both.

Referring to FIG. 1 there is shown a valve 10 having a head 11 which is movable in an axial direction to seal the passageway 5. The valve 10 is slidably mounted in a bore 12 in cylinder block 13 and passes through a cavity 14. In the cavity 14 around valve 10 there is located a spring 15 one end of which rests against a lower surface of said cavity 14 and the other end of which is located in a collar 16 mounted on the valve 10 so as to generally bias the valve 10 in an upwards direction.

Mounted on an upper end of valve 10 is a tappet assembly 18. The tappet assembly 18 comprises a coaxial inner tappet 20 and outer tappet 21. The inner tappet bears on a hydraulic lash adjustment element 22 of known type which in turn bears on the upper end of valve 10. The tappet assembly 18 is slidably mounted within bore 19 which extends from the cavity 14 to the upper surface of the cylinder block 13. A cylinder head cover may be positioned over and secured to the upper surface of the cylinder block 13.

Located above the cylinder block 13 is a rotatable camshaft 30, which is drivable in the usual arrangement 31, which comprises a pair of outer cam lobes 26 in between which is situated a central cam lobe 23. The central cam lobe 23 has a profile designed to optimise engine performance over a selected portion of engine speed and load range. Although the central cam lobe 23 is illustrated as having a generally eccentric form it is envisaged that this cam lobe can be a circular form allowing valve deactivation while under control of this cam lobe. The outer cam lobes 26 are of a substantial identical profile to each other and are designed to optimise engine performance over another portion of engine speed and load range.

The camshaft 30 is located such that in low speed conditions an upper surface 20*a* of the inner tappet 20 is driven by the central cam lobe via finger follower 24. The upper surface 21*a* of outer tappet 21 is kept in contact with the outer cam lobes 26 by means of a spring 25 which is co-axially positioned around spring 15 and which locates at one end in recesses 32 in the lower end surface of outer tappet 21. At its lower end spring 25 bears on the lower surface of cavity 14.

Cam profile selection is achieved by either connecting the inner tappet 20 and outer tappet 21 so that they move together which allows the outer tappet 21 and outer cam lobes 26 to control the valve 10 or by disconnecting the inner tappet 20 and outer tappet 21, which allows the inner tappet 20 and inner cam lobe 23 to control valve 10.

One method of achieving this connection is by the use of locking pins 27, shown in FIGS. 1-5. The locking pins 27 slide in transverse bores 28 in the outer tappet 21 and are engagable with a stepped diameter 29 on the inner tappet 20 while the cam 31 is on its base circle, i.e. whilst the valve 10 is closed.

Figure 3:
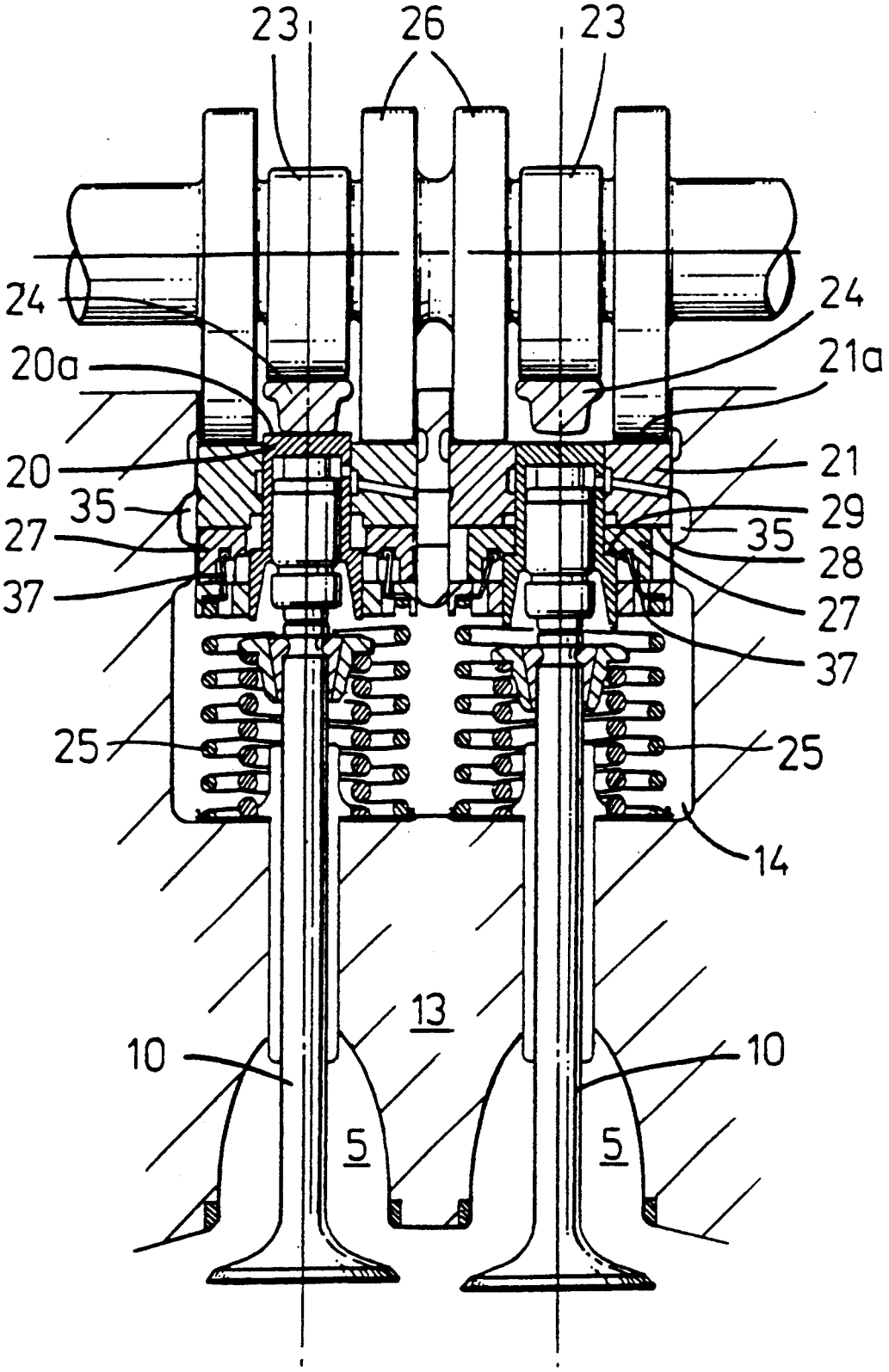
FIG. 3 is a side sectional elevation of two of the adjacent tappet and valve assemblies of FIG. 1 in different conditions.

During the deactivated state the locking pins 27 are in their retracted position as shown in the left hand portion of FIG. 3. The pins 27 can be held in this position by either a return spring 37 or oil pressure on the inboard surfaces. With the pins in this position there is no connection between the inner tappet 20 and outer tappet 21. Since outer tappet 21 moves against spring 25, the valve 10 is driven solely by the inner tappet 20 by central cam lobe 23 bearing on finger 24.

In the activated state, the locking pins 27 are forced inwards by hydraulic oil pressure on their outer surfaces provided by gallery feed 35. The oil pressure must be sufficient to overcome the spring force or oil pressure on the inner surface of the locking pins 27. In this position, the locking pins 27 engage with the stepped diameter 29 on the inner tappet 20 thus forming a driving connection between the inner tappet 20 and outer tappet 21.

Because of the difference in radii of the outer and inner cam lobes, only the outer cam lobes 26 bear on the surface 21*a* of the outer tappet 21 whilst there is a gap between the inner tappet 20 and the central cam lobe 23. Since both tappets 20, 21 are constrained to move together the large profile of the outer cam lobe 26 governs the movement of valve 10. In this condition the finger follower 24 is held in contact with the central cam profile 23 by a spring 38.

Figure 4:
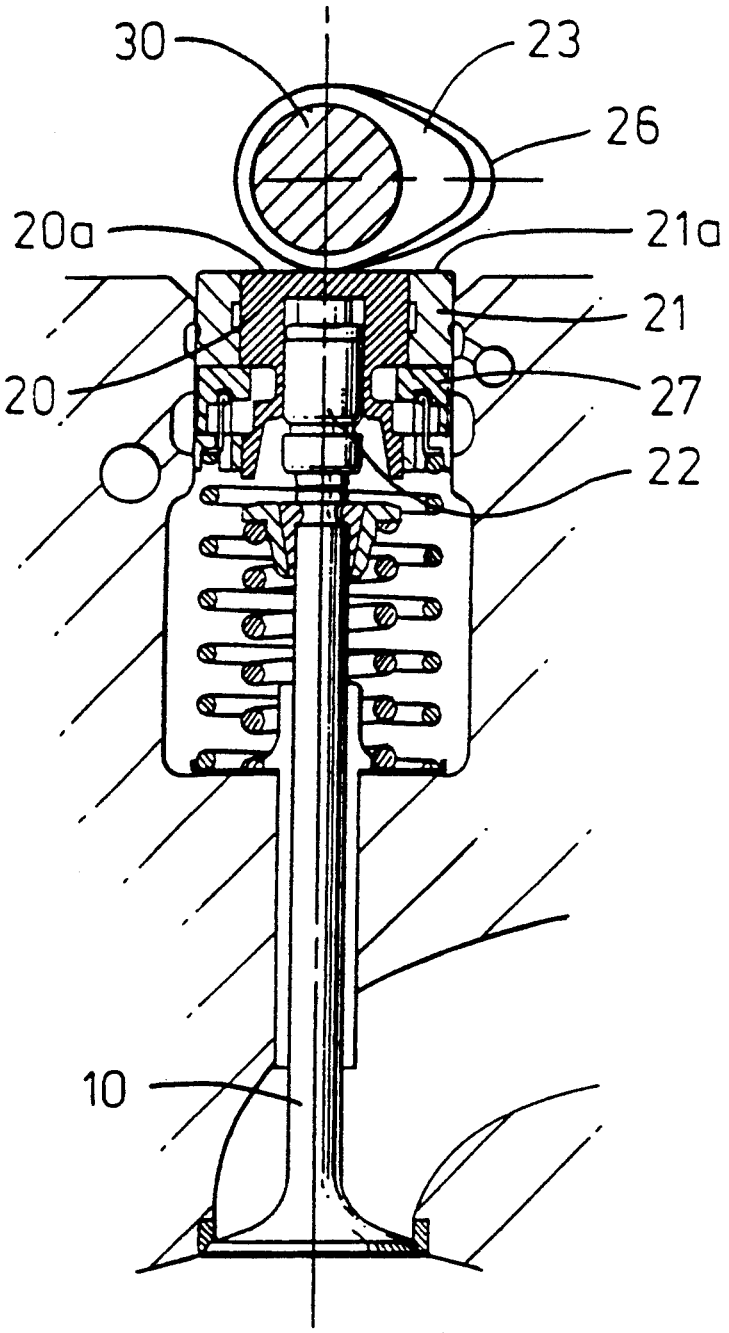
FIG. 4 is an alternative valve and tappet arrangement to that shown in FIG. 1.
Figure 5:
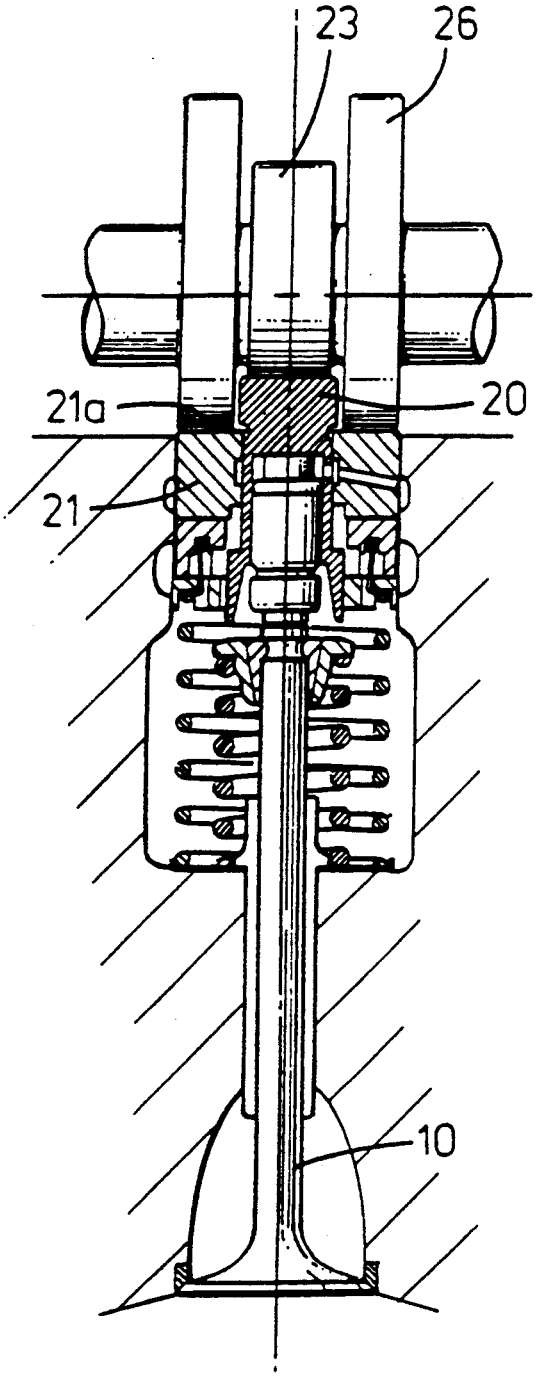
FIGS. 5 and 6 are views of another alternative embodiment.
Figure 6:
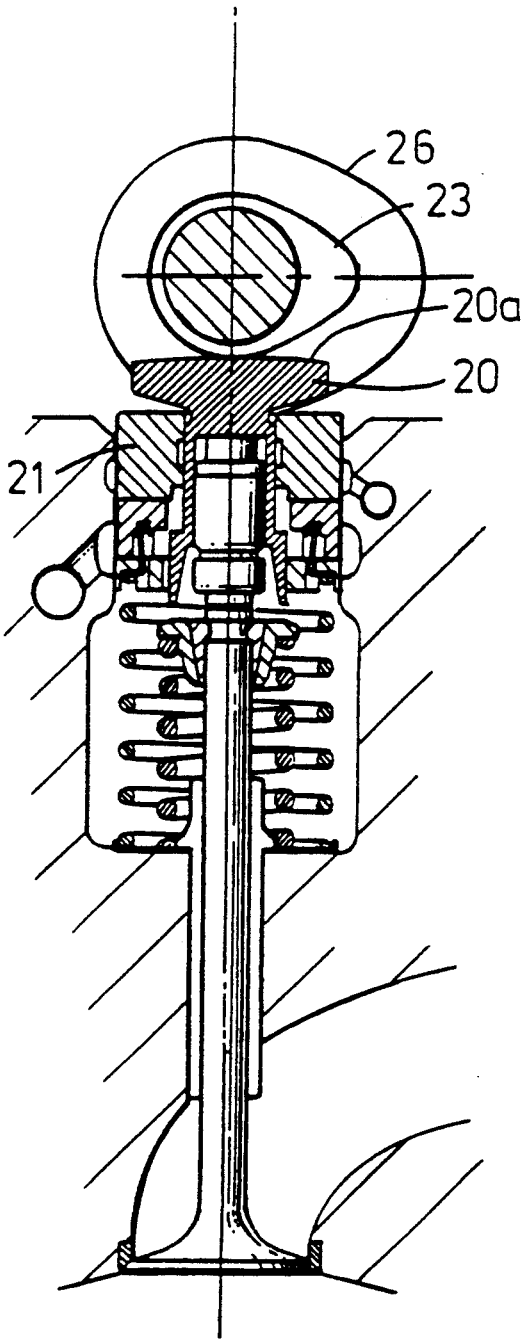

FIG. 4 illustrates an alternative arrangement in which the inner tappet 20 is driven directly by the central cam lobe 23 rather than via finger follower 24. FIGS. 5 and 6 illustrate yet another alternative embodiment where the inner tappet 20 is driven directly by the central cam lobe 23 in which the inner tappet 20 has a different shape than that shown in FIG. 4.

Figure 7:
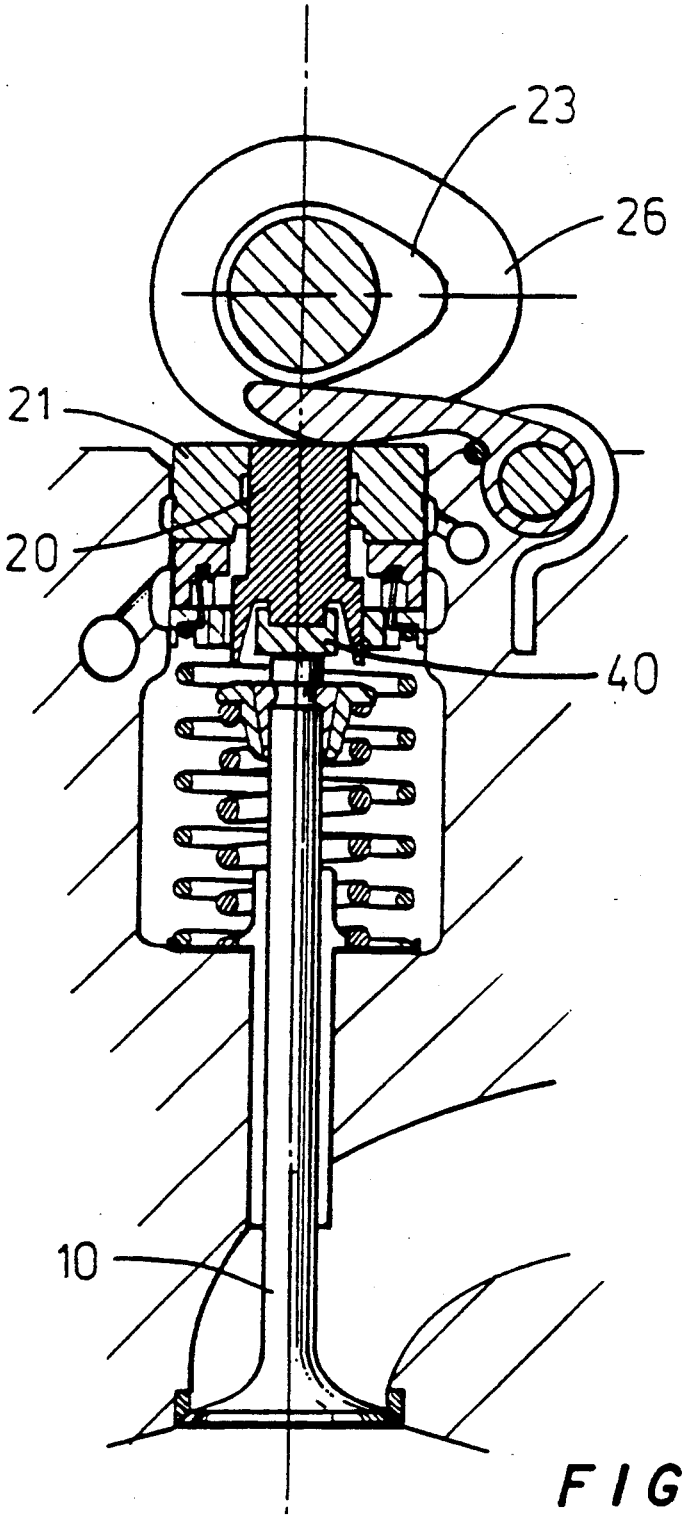
FIG. 7 is another alternative tappet and valve assembly to the arrangement of FIG. 1.

FIG. 7 illustrates a further embodiment of the invention whereby the hydraulic element 22 is replaced by a conventional shim 40 such that the central tappet 20 acts directly on the valve 10.

We claim:

1. Valve control means for an internal combustion engine comprising valve means, cam means comprising a rotatable camshaft having a first cam member and a second cam member having a different profile from said first cam member, means for transmitting reciprocating movement to the valve means from said cam means, said transmitting means comprising a first cam follower member in engagement with said valve means and a second cam follower member movable relative to said first cam follower member, and locking means to enable said follower members to be linked so as to move together, wherein when the follower members are not so linked the valve means is controlled by the first cam follower member in engagement with and following the profile of the first cam member and when the follower members are linked the valve means is controlled by the second cam follower member in engagement with the following the profile of the second cam member and wherein the second cam follower member has a bore therethrough and the first cam follower member is in the form of an inner member located within the bore, said first cam second cam follower member when the cam follower members are not linked to move together.

2. Valve control means as claimed in claim 1 wherein the second cam follower member is generally cylindrical and has a generally cylindrical bore therethrough and the first cam follower member is a cylindrical member located within the cylindrical bore of the second cam follower member.

3. Valve control means as claimed in claim 2 wherein the locking means comprises a locking element movable within the second cam follower member between a first position in which the cam follower members are not linked and a second position in which the locking element engages a stepped diameter of the first cam follower member to link the two cam follower members.

4. Valve control means as claimed in claim 1 wherein the lower edge of only the first cam follower member directly abuts the top of the controlled valve whereby when the cam follower members are disconnected the second cam follower member makes no contact with the valve and transmits no motion thereto.

5. Valve control means as claimed in claim 1 further comprising hydraulic lash adjustment means located between the valve and said first cam follower member.

6. Valve control means as claimed in claim 1 wherein the first and second cam follower members each respectively directly abut the first and second cam members of the rotatable camshaft.

7. Valve control means as claimed in claim 1 further comprising a third cam follower member located between said first cam follower member and said first cam member to provide indirect engagement therebetween.

8. Valve control means as claimed in claim 7 in which said third follower member is held in engagement with said first cam member by spring means.

9. Valve control means as claimed in claim 1 comprising a third cam member on the rotatable camshaft having the same profile as the second cam member and provided on the side of the first cam member opposite to the second cam member, wherein the second cam follower member engages with and follows the profiles of both the second and the third cam members.

10. Valve control means as claimed in claim 1 in which actuating means are provided to actuate and de-actuate the locking means for different speeds and loads of the engine.

11. Valve control means as claimed in claim 10 in which the actuating means are manually or automatically operable.

12. Valve control means as claimed in claim 1 in which the first and second cam follower members are linked at higher engine speeds to improve efficiency of the engine.

13. Valve control means as claimed in claim 1 in which the locking means comprises a locking element movable within said second cam follower member and held restrained in an unlocked position by spring means.

14. Valve control means as claimed in claim 1 in which the locking means comprises a locking element movable within said second cam follower member and held restrained in an unlocked position by fluid pressure.

15. Valve control means as claimed in claim 13 in which the locking element has a shaped surface adapted to cooperate with a complementary surface of said first cam follower member in a locked position.

16. Valve control means as claimed in claim 14 in which the locking element has a shaped surface adapted to cooperate with a complementary surface of said first cam follower member in a locked position.

17. Valve control means as claimed in claim 13 in which the locking element is moved from an unlocked position to a locked position by means of fluid pressure.

18. Valve control means as claimed in claim 14 in which the locking element is moved from an unlocked position to a locked position by means of fluid pressure.

19. Valve control means as claimed in claim 13 wherein the first cam follower member has a stepped portion and the locking element engages the stepped portion to link the first and second cam follower members.

20. Valve control means as claimed in claim 14 wherein the first cam follower member has a stepped portion and the locking element engages the stepped portion to link the first and second cam follower members.

21. Valve control means as claimed in claim 1 in which the second cam follower member is held in engagement with the second cam member by spring means.

22. Valve control means as claimed in claim 1 in which the second cam follower member is biased toward said second cam member by spring means.

23. Valve control means as claimed in claim 22 in which the spring means hold the second cam follower member in engagement with the second cam member when the cam follower members are not linked to move together.

24. Valve control means as claimed in claim 1 in which when the second cam follower member is linked in engagement with said first cam follower member there is a gap between said first cam follower member and said first cam member during the period in which the second cam follower member engages the lift portion of the second cam member.

25. An internal combustion engine having valve control means as claimed in claim 1.

26. An internal combustion engine having valve control means as claimed in claim 2 wherein the cylinder head of the engine has a bore in which the first and second cam follower members are located, the second cam follower member being slidable in the bore relative to the cylinder head.

* * * * *

UNITED STATES PATENT AND TRADEMARK OFFICE

CERTIFICATE OF CORRECTION

PATENT NO. : 5,287,830

DATED : February 22, 1994

INVENTOR(S) : Clive Dopson; Jeffrey Allen

It is certified that error appears in the above-indentified patent and that said Letters Patent is hereby corrected as shown below:

In Column 1, line 68, delete "value" and insert --valve--;

In Column 5, line 24, after "said first cam" insert --follower member being movable in the bore relative to the--.

Signed and Sealed this

Twenty-seventh Day of September, 1994

*Attest:*

Bruce Lehman

BRUCE LEHMAN

*Attesting Officer*

*Commissioner of Patents and Trademarks*